US010029389B1

(12) United States Patent
Baker

(10) Patent No.: US 10,029,389 B1
(45) Date of Patent: Jul. 24, 2018

(54) CONCENTRIC GROWTH RING BASEBALL BAT

(71) Applicant: Teddy Howard Baker, Burnesville, NC (US)

(72) Inventor: Teddy Howard Baker, Burnesville, NC (US)

( * ) Notice: Subject to any disclaimer, the term of this patent is extended or adjusted under 35 U.S.C. 154(b) by 0 days.

(21) Appl. No.: 15/530,348

(22) Filed: Dec. 30, 2016

(51) Int. Cl.
*B27M 3/22* (2006.01)
*A63B 59/52* (2015.01)

(52) U.S. Cl.
CPC ..... *B27M 3/22* (2013.01); *A63B 59/52* (2015.10)

(58) Field of Classification Search
CPC ..... B27M 3/22; A63B 59/50; A63B 59/52; A63B 59/80; B27D 1/086
USPC ..... 473/564
See application file for complete search history.

(56) References Cited

U.S. PATENT DOCUMENTS

2015/0144226 A1* 5/2015 Suthar ..... B27K 1/00 144/356
2015/0265893 A1* 9/2015 Ledoux, Jr. ..... B27D 1/086 144/355

OTHER PUBLICATIONS

John Swartzwelder, The Simpsons S03E17, Homer at the Bat, Feb. 20, 1992, Fox network, 2:20-3:01.*

* cited by examiner

*Primary Examiner* — Matthew G Katcoff

(57) ABSTRACT

A baseball bat fabricated from a limb of a tree, procured without harvesting any of the tree's trunk. Because of this technique, the process of the present invention is much less wasteful. Many bats can be fabricated from a single tree, without felling the tree itself. The process of fabrication of the present invention is drawn to working with the properties of the harvested tree limb. In this manner, a billet is fabricated on a lathe with its center placed concentric with the center of the tree limb, thusly concentric with the limb's growth rings. By doing so, the growth rings within the limb will not be bisected during fabrication of the billet. When the billet is further turned on a lathe to shape the billet into a baseball bat, the growth rings within the limb will be minimally bisected, thus increasing the strength of the baseball bat of the present invention, as compared to the baseball bats of the prior art.

2 Claims, 4 Drawing Sheets

CONCENTRIC GROWTH RING BASEBALL BAT

TECHNICAL FIELD

The present invention relates to a baseball bat, and more particularly a baseball bat fabricated concentrically with the growth rings of a tree limb.

BACKGROUND

Traditional baseball bats are made of a variety of trees such as ash trees, maple trees, red oak trees, hickory trees, poplar trees, or nearly any variety of tree. Ash and maple trees are the most popular variety of trees used to make baseball bats. These trees must reach a trunk diameter of greater than 12 inches. Nearly fifty years of growth is required for an ash tree to reach a minimum size required for harvesting to manufacture baseball bats. These trees are then cut, limbed, split, and placed in a lathe. The lathe turns and shaves the splits of wood into cylinders known as billets. These billets are placed into a lathe that shapes the billets into a baseball bat complete with a knob, handle, and barrel.

This process is wasteful as nearly half the ash tree is unacceptable for making baseball bats. The limbs of the tree are completely wasted. Further, the natural seams of the ash wood, present between growth rings, weaken the bat. These seams are not taken into consideration when producing billets or bats. Even further, the billets and eventual baseball bats are made of wood of consistent density without the possibility of tuning a varying density along the length of the bat.

The present invention addresses these and other problems of traditional methods of manufacturing baseball bats.

SUMMARY OF THE INVENTION

The baseball bat of the present invention is fabricated in ways to solve the drawbacks of the prior art.

Initially, the present invention is fabricated from a limb of a tree, procured without harvesting any of the tree's trunk. Because of this technique, the process of the present invention is much less wasteful. Many bats can be fabricated from a single tree, without felling the tree itself.

The process of fabrication of the present invention is drawn to working with the properties of the harvested tree limb. In this manner, a billet is fabricated on a lathe with its center placed concentric with the center of the tree limb, thusly concentric with the limb's growth rings. By doing so, the growth rings within the limb will not be bisected during fabrication of the billet. When the billet is further turned on a lathe to shape the billet into a baseball bat, the growth rings within the limb will be minimally bisected, thus increasing the strength of the baseball bat of the present invention, as compared to the baseball bats of the prior art.

The baseball bats of the prior art are fabricated of harvested wood with a consistent density. By procuring a tree's limb that does not contain any of the tree's trunk, the billets and the eventual bats will have a varying density. Being that the density of the limb is greater nearer the tree's trunk, the center of gravity of the billet and the eventual baseball bat will be shifted from the center of the billet towards the end of the billet that was fabricated from the portion of the limb that was situated closer to the tree's trunk.

Taking into consideration this varying density of the limb, billet, and eventual bat, the process of the present invention ideally fabricates baseball bats tuned for greater performance as well as tuned for more productive training. In this manner a baseball bat with less density and weight at its barrel will swing faster for higher performance. Further, a baseball bat with greater density and weight at its barrel will swing with greater resistance for more productive training.

In accordance with these and other objects, which will become apparent hereinafter, the instant invention will now be described with particular reference to the accompanying drawings.

DETAILED DESCRIPTION OF THE DRAWINGS

Figure 1:
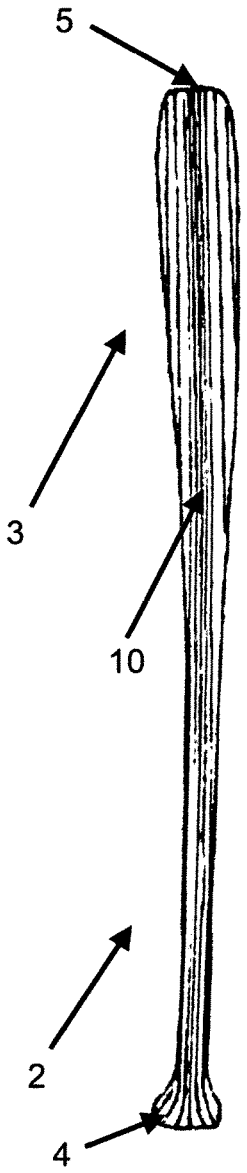
FIG. 1 is a cross section of a baseball bat formed by the method of the present invention.

FIG. 1 shows is a cross section of a baseball bat formed by the method of the present invention. The baseball bat of FIG. 1 comprises a handle (2) and a barrel (3). The handle (2) is from at the proximal end (4) of the baseball bat (1). The barrel is formed at a distal end (5) of the baseball bat (1). The center (10) of the baseball bat (1) runs the length of the baseball bat (1) from the proximal end (4) to the distal end (5).

Figure 2:
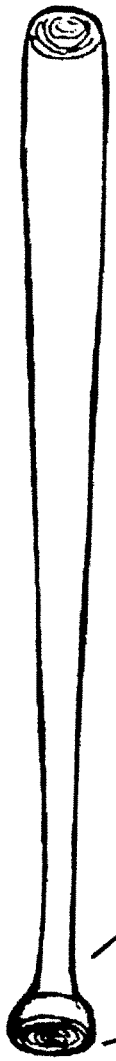
FIG. 2 is a perspective view of a baseball bat formed by the method of the present invention.
Figure 4:
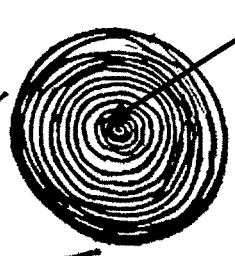
FIG. 4 is a perspective view of a knob of a baseball bat formed by the method of the present invention.

FIG. 2 shows a perspective view of a baseball bat (1) formed by the method of the present invention. FIG. 4 is a view of just the knob of the baseball bat (1). As can be seen in FIGS. 1, 2. and 4, the baseball bat is formed concentric with the concentric growth rings of the tree limb.

Figure 3:
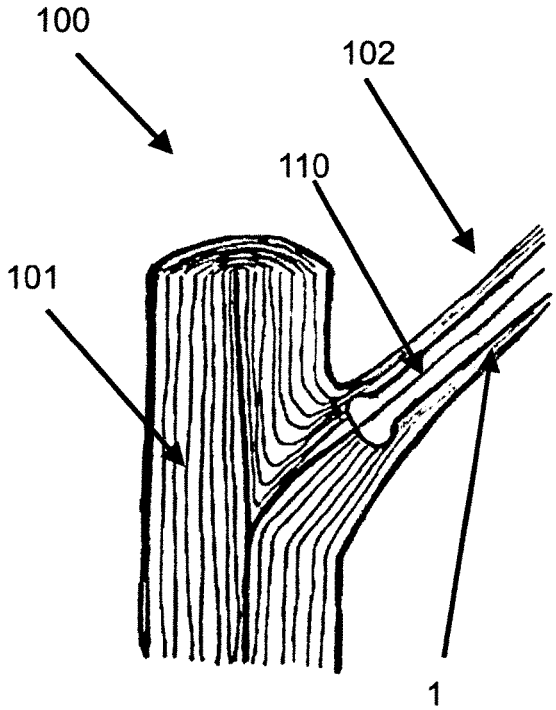
FIG. 3 is a cross section of a tree showing an orientation of a baseball bat that would be formed by the method of the present invention.

FIG. 3 shows a cross section of a tree (100) showing an orientation of a baseball bat (1) that would be formed by the method of the present invention. The tree (100) includes a trunk (101) and a limb (102). The limb (102) has a center growth ring (110) running along its length at a center of the limb, as is shown in FIG. 3.

Figure 5:
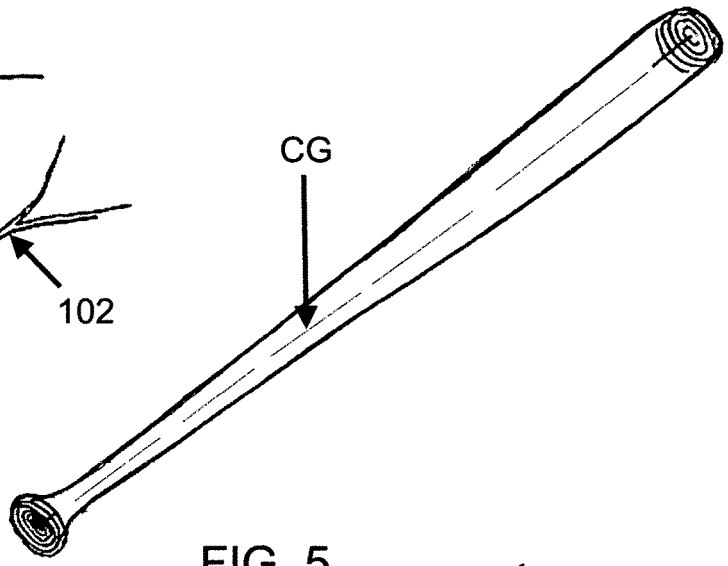
FIG. 5 is a perspective view of a baseball game bat formed by the method of the present invention.
Figure 7:
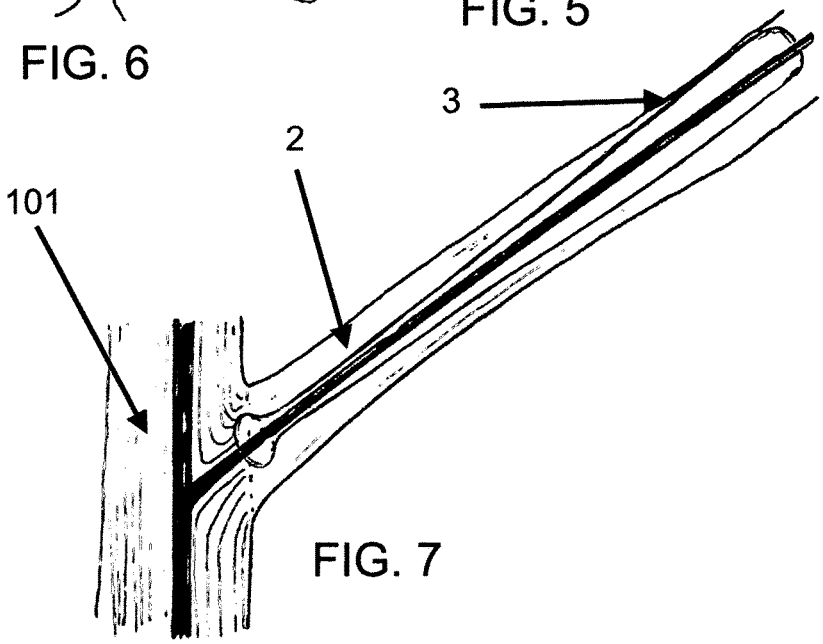
FIG. 7 is a cross section of a tree showing an orientation of a baseball game bat that would be formed by the method of the present invention.
Figure 8:
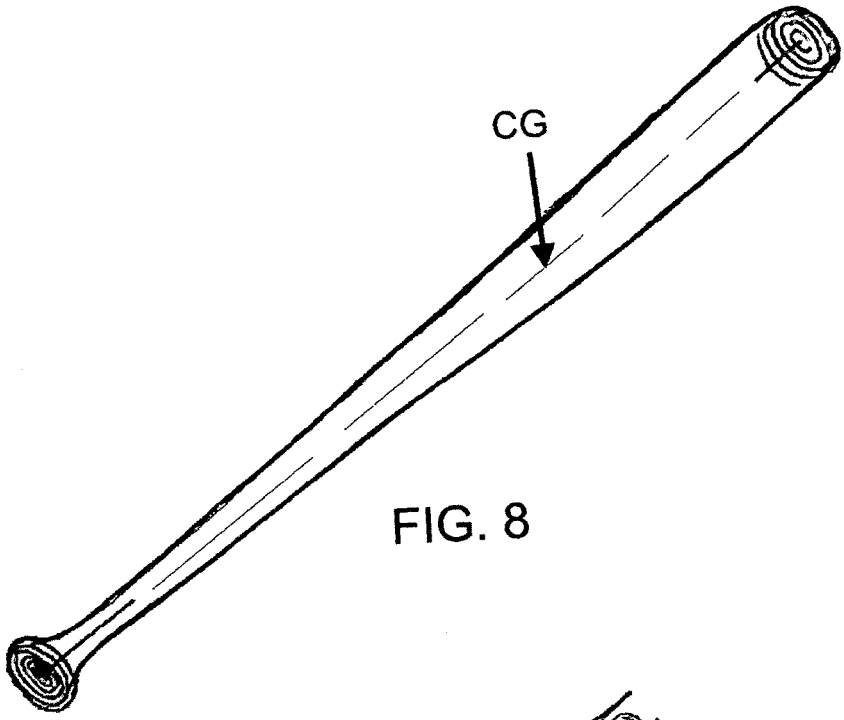
FIG. 8 is a perspective view of a baseball practice bat formed by the method of the present invention.
Figure 9:
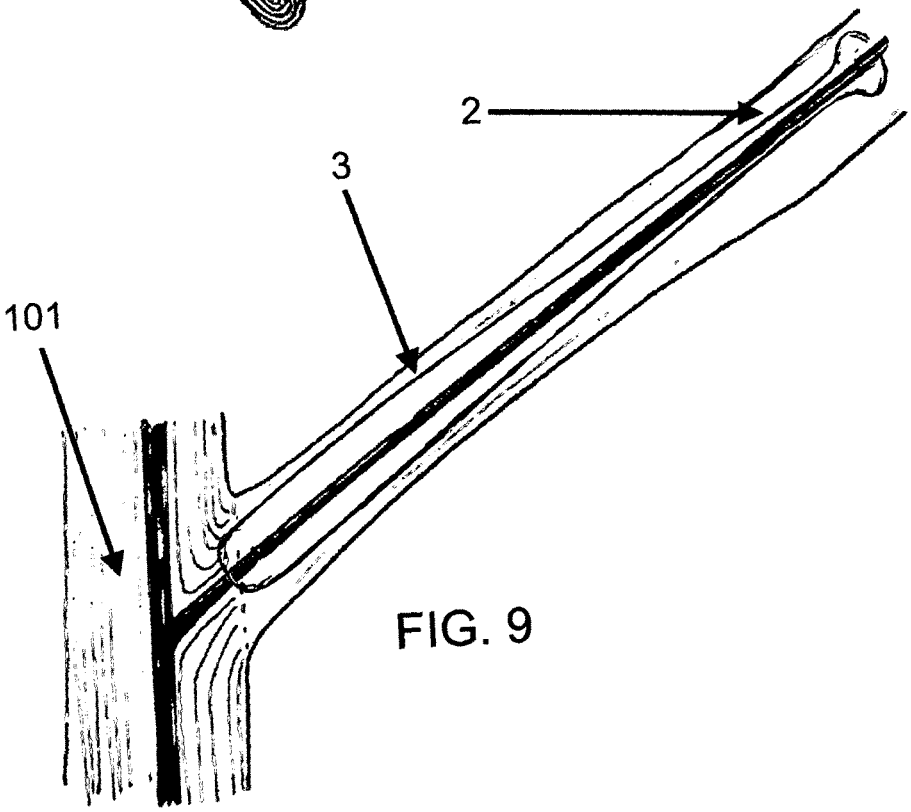
FIG. 9 is a cross section of a tree showing an orientation of a baseball practice bat that would be formed by the method of the present invention.

FIG. 5 is a perspective view of a baseball game bat formed by the method of the present invention. FIG. 8 is a perspective view of a baseball practice bat formed by the method of the present invention. The arrows in FIGS. 5 and 8 are representations of the densities of the baseball bats. Each arrow extends a varying length of the baseball bat to delineate sections that would have an equivalent weight if these sections were cylinders with identical diameters, as is the case with billets. Therefore, longer arrows and sections are required in areas of the limbs, billets, and baseball bats in less dense areas to each the weight represented by shorter arrows in more dense areas. Because of this density disparity, the smaller arrows nearer the handle and the knob of the baseball bat will have greater weight in identically sized sections in FIG. 5. Further, the longer arrows nearer the handle and knob of the baseball bat will a lesser weight in identically sized sections in FIG. 8. These sections constantly vary based on the orientation of the baseball bat with respect to how the limbs, billets, and baseball bats are harvested from the tree. As is shown in FIG. 7, if the limbs, billets, and baseball bats are harvested from the tree with the knob and handle closer to the trunk, then a baseball game bat will be produced with a center of gravity (CG; as indicated by the center line in FIG. 5) closer to the knob and handle, as is shown in FIG. 5. As is shown in FIG. 9, if the limbs, billets, and baseball bats are harvested from the tree with the barrel closer to the trunk, then a baseball practice bat will be produced with a center of gravity (CG; as indicated by the center line in FIG. 8) closer to the distal end of the baseball bat, as is shown in FIG. 8.

Figure 6:
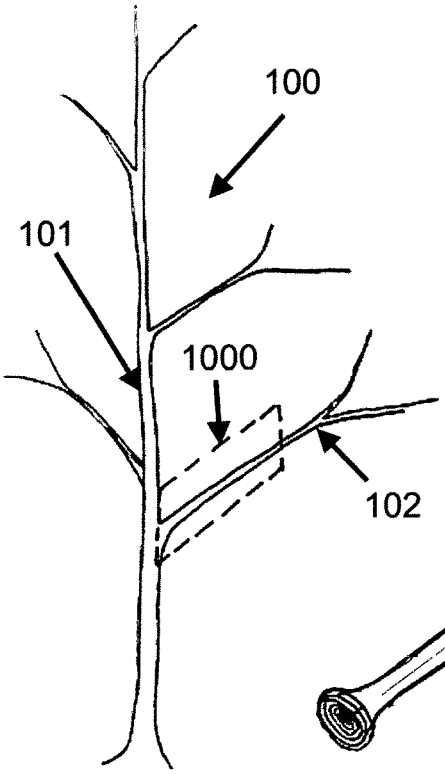
FIG. 6 is a perspective view of a tree showing an orientation of a portion of limb to be harvested to form a baseball bat by the method of the present invention.

FIG. 6 is a perspective view of a tree (100) showing an orientation of a portion (1000) of a limb (102) to be harvested to form a baseball bat by the method of the present invention. As is depicted in FIG. 6, the portion (1000) to be harvested from the limb (102) does not include any of the tree's (100) trunk (101). In this manner, the entire tree (100) does not need to be harvested. This approach is much less wasteful and much more environmentally friendly than the traditional approach of felling an entire tree in order to make baseball bats.

Figure 10:
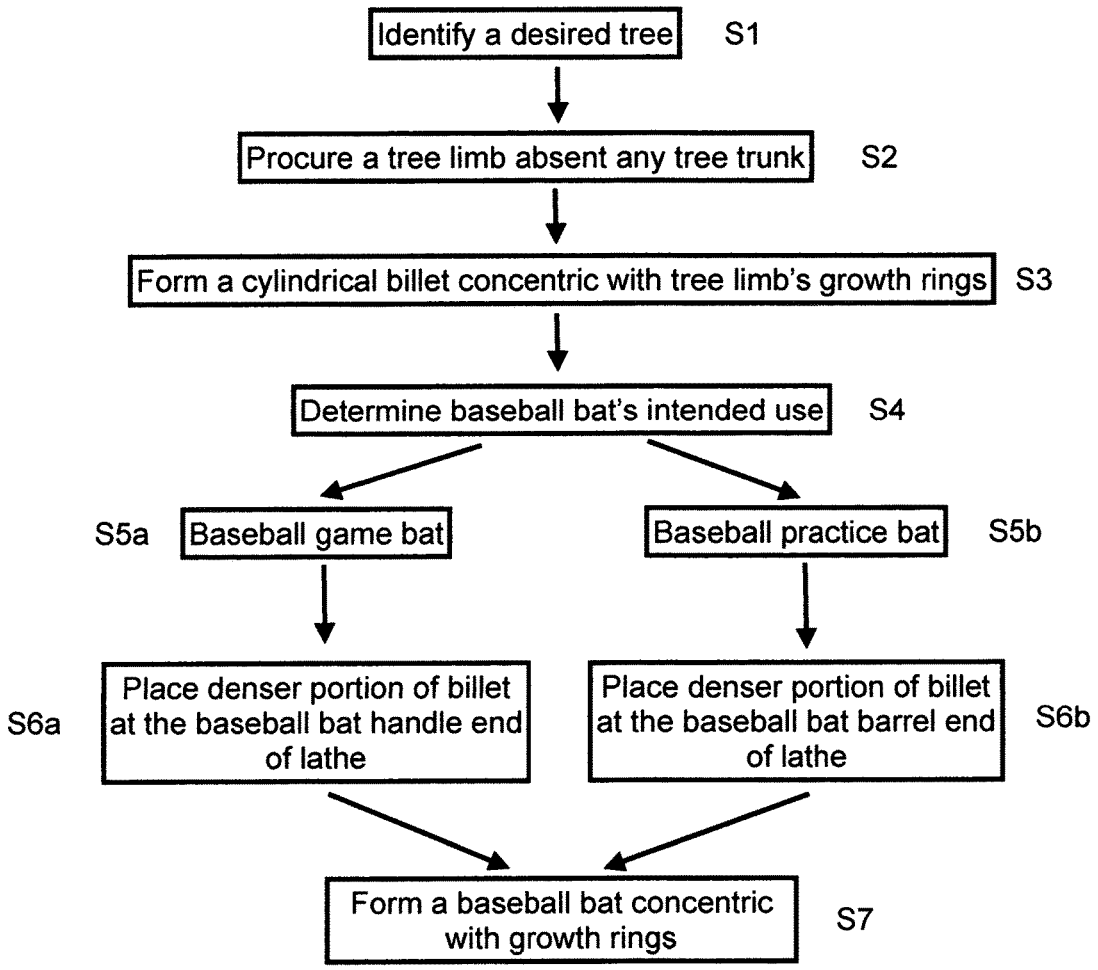
FIG. 10 is a depiction of the method of the present invention.

FIG. 10 is a depiction of the method of the present invention. Step 1 (S1) requires identifying a desired tree (100). In most cases an ash tree of nearly 50 years in age is required to produce acceptable baseball bats. But trees of varying types and ages are contemplated in the present invention. Step 2 (S2) require procuring a tree limb absent any tree trunk. By harvesting only the tree limb (102) and leaving the tree trunk (101) (see: FIG. 6), the tree (100) will not need to be sacrificed to produce baseball bats of the present invention. Step 3 (S3) requires forming a cylindrical billet concentric with the tree limb's growth rings. As can be seen in FIGS. 1-4, the growth rings within the limb will not be bisected during fabrication of the billet, thus increasing the strength of the baseball bat of the present invention, as compared to the baseball bats of the prior art. Step 4 (S4) requires a determination of the intended use of the baseball bat. As is shown in FIGS. 5 and 7-9, the orientation of the limb, billet, and baseball bat within the lathe will be opposite for the baseball game bat shown in FIGS. 5 and 7 and for the baseball practice bat shown in FIGS. 8 and 9. Steps 5*a* and 6*a* (S5*a* and S6*a*) require for production of a baseball game bat that the billet be placed into a lathe with the denser portion of the billet at the baseball bat handle end of the lathe. Steps 5*b* and 6*b* (S5*b* and S6*b*) require for production of a baseball practice bat that the billet be placed into a lathe with the denser portion of the billet at the baseball bat barrel end of the lathe. By this technique and as is shown in FIG. 7, if the limbs, billets, and baseball bats are harvested from the tree with the knob and handle closer to the trunk, then a baseball game bat will be produced with a center of gravity (CG) closer to the knob and handle, as is shown in FIG. 5. As is shown in FIG. 9, if the limbs, billets, and baseball bats are harvested from the tree with the barrel closer to the trunk, then a baseball practice bat will be produced with a center of gravity (CG) closer to the distal end of the baseball bat, as is shown in FIG. 8. Step 7 (S7) requires forming a baseball bat concentric with the growth rings, as is shown in FIGS. 1, 2, and 4.

While preferred embodiments of the present invention have been described above, it is understood that variations and modification will be apparent to those skilled in the art, without departing from the scope and spirit of the present invention. The scope of the present invention, therefore, is to be determined solely by the following claims.

What is claimed:

1. A method of forming a baseball game bat from a tree limb, the method comprising:

a first step of procuring a tree limb from a tree, the tree limb having concentric growth rings;

a second step of forming the limb into a cylindrical billet having a diameter and a central longitudinal axis that is perpendicular to the diameter, wherein the growth rings are concentrically formed with respect to the diameter of the cylindrical billet and the growth rings extend along said central longitudinal axis of the cylindrical billet;

a third step of determining a more dense portion and a less dense portion of the cylindrical billet;

a fourth step of forming the cylindrical billet into the baseball game bat, wherein the forming step includes forming one portion of the cylindrical billet into a barrel and an adjacent portion of the cylindrical billet into a handle, the handle has a smaller diameter than the barrel, wherein the handle is formed from the more dense portion of the cylindrical billet and the barrel is formed from the less dense portion of the cylindrical billet, wherein the baseball game bat has a handle end which is closer to the handle, a barrel end which is closer to the barrel, a diameter and a central longitudinal axis perpendicular to the diameter running from the handle end to the barrel end, wherein, after the baseball game bat is formed, the center of gravity of the baseball game bat is closer to the handle end than to the barrel end, and the growth rings are concentrically formed with respect to the diameter of the baseball game bat and the growth rings extend along the central longitudinal axis of the baseball game bat.

2. A method of forming a baseball practice bat from a tree limb, the method comprising:

a first step of procuring a tree limb from a tree, the tree limb having concentric growth rings;

a second step of forming the tree limb into a cylindrical billet having a diameter and a central longitudinal axis that is perpendicular to the diameter, wherein the growth rings are concentrically formed with respect to the diameter of the cylindrical billet and the growth rings extend along said central longitudinal axis of the cylindrical billet;

a third step of determining a more dense portion and a less dense portion of the cylindrical billet;

a fourth step of forming the cylindrical billet into the baseball practice bat, wherein the forming step includes forming one portion of the cylindrical billet into a handle and an adjacent portion of the cylindrical billet into a barrel, the handle has a smaller diameter than the barrel, wherein the handle is formed from the less dense portion of the cylindrical billet and the barrel is formed from the more dense portion of the cylindrical billet, wherein the baseball practice bat has a handle end which is closer to the handle, a barrel end which is closer to the barrel, a diameter and a central longitudinal axis perpendicular to the diameter running from the handle end to the barrel end, wherein, after the baseball practice bat is formed, the center of gravity of the baseball game bat is closer to the barrel end than to the handle end and the growth rings are concentrically formed with respect to the diameter of the baseball practice bat and the growth rings extend along the central longitudinal axis of the baseball practice bat.

* * * * *